US006056603A

United States Patent [19]

Pauza

[11] Patent Number: 6,056,603

[45] Date of Patent: May 2, 2000

[54] SACRIFICIAL PLASTIC RIB FOR CONTACT RETENTION

[75] Inventor: William Vito Pauza, Palmyra, Pa.

[73] Assignee: The Whitaker Corporation, Wilmington, Del.

[21] Appl. No.: 09/096,780

[22] Filed: Jun. 12, 1998

Related U.S. Application Data

[60] Provisional application No. 60/081,107, Apr. 8, 1998.

[51] Int. Cl.[7] ..... H01R 13/40

[52] U.S. Cl. ..... 439/733.1; 439/79

[58] Field of Search ..... 439/733.1, 79, 439/603, 869

[56] References Cited

U.S. PATENT DOCUMENTS

| | | | |
|---|---|---|---|
| 3,850,497 | 11/1974 | Krumreich et al. | 439/545 |
| 4,210,376 | 7/1980 | Hughes et al. | 339/17 LC |
| 4,425,015 | 1/1984 | Rizzo | 339/17 LC |
| 4,478,478 | 10/1984 | Durand | 439/733.1 |
| 4,639,056 | 1/1987 | Lindeman et al. | 339/17 LC |
| 4,660,911 | 4/1987 | Reynolds et al. | 339/17 LC |
| 4,697,864 | 10/1987 | Hayes et al. | 439/444 |
| 4,802,860 | 2/1989 | Kikuta | 439/79 |
| 4,842,528 | 6/1989 | Frantz | 439/80 |
| 4,850,902 | 7/1989 | Reed | 439/676 |
| 5,122,078 | 6/1992 | Davis et al. | 439/405 |
| 5,131,871 | 7/1992 | Banakis et al. | 439/444 |
| 5,145,383 | 9/1992 | Bowen et al. | 439/78 |
| 5,266,038 | 11/1993 | Nakamura | 439/79 |
| 5,674,083 | 10/1997 | Whiteman, Jr. et al. | 439/181 |
| 5,779,489 | 7/1998 | Davis et al. | 439/79 |

FOREIGN PATENT DOCUMENTS

| | | | |
|---|---|---|---|
| 7-272803 | 3/1994 | Japan | H01R 23/68 |

*Primary Examiner*—Michael L. Gellner
*Assistant Examiner*—Antoine Ngandjui

[57] ABSTRACT

The invention relates to electrical connectors or more particularly to an improved technique for mounting metal contacts in an electrical connector. Such a technique employs frangible sacrificial ribs in connector channels which engage the contacts upon insertion into the channels and bias the insertion force in a controlled direction thus avoiding connector breakage. The connector has a housing composed of an insulating material and an array of linearly aligned channels extending through a surface of the housing. Each of the channels is defined by internal peripheral walls. At least one frangible dielectric projection extends from a wall of each channel into the channel. The projections are situated either at a same position on each channel wall or at a opposed position on each channel wall of the array of channels.

22 Claims, 3 Drawing Sheets

SACRIFICIAL PLASTIC RIB FOR CONTACT RETENTION

CROSS REFERENCE TO RELATED APPLICATION

This application claims the benefit of provisional patent application Ser. No. 60/081,107 filed Apr. 8, 1998 which is incorporated herein by reference.

FIELD OF THE INVENTION

The present invention relates to electrical connectors or more particularly to an improved technique for mounting metal contacts in an electrical connector. Such a technique employs frangible sacrificial ribs in connector channels which engage the contacts upon insertion into the channels and bias the insertion force in a controlled direction thus avoiding connector breakage.

BACKGROUND OF THE INVENTION

Electronic equipment, such as computers and cellular telephones, typically contain various circuit boards that in turn contain electronic components which are interconnected via metalized circuitry on the circuit boards. Electrical connectors are frequently used to interconnect a circuit board to other circuit boards or to other components of the equipment. With the continuing advance of electronic technology, the individual components of the electronic equipment are made ever smaller resulting in miniaturized but highly dense packages. Connector technology has similarly migrated toward smaller and thinner structures. When a connector is formed, an insulating housing is provided with an array of electrical contacts mounted in the housing. The contacts must subsequently be brought into mating engagement a circuit board or other connector. The contacts are typically mounted in the connector by inserting each individual contact into a molded channel in the connector housing. Since it has become necessary to employ very thin insulating connector structures, it has become a problem in the art to insert the contacts into the connector housing without fracturing the housing material. Since it has been necessary to establish a snug fit of the contacts in the connector channels, the combined forces applied when an array of contacts is pressed into an array of channels tends to cause the housing material to break. It has now been found that by use of a connector having a sacrificial, frangible projection in each channel, that the forces generated when the contacts are inserted into the channels can be biased in a direction which will avoid braking the housing.

SUMMARY OF THE INVENTION

The invention provides an electrical connector comprising an housing comprising a insulating material having at least one array of linearly aligned channels extending through a surface of the housing; each of said channels being defined by internal peripheral walls; and at least one frangible dielectric projection extending from a wall of each channel a part of the distance into each channel; said projections being situated either at a same position on each channel wall or at a opposed position on each channel wall of the array of channels.

The invention also provides an electrical connector comprising a housing comprising an insulating material having at least one array of horizontally aligned channels extending through a front surface of the housing; each of said channels having opposed side walls, a ceiling and a floor; each of said side walls being vertically aligned parallel to one another and perpendicular to the ceiling and floor of the channels; the floors of each array of channels being coplanar and the ceilings of each array of channels being coplanar; and at least one frangible dielectric projection extending from each ceiling a part of the distance into each channel toward a channel floor.

The invention further provides an electrical connector comprising (a) a housing comprising an insulating material having at least one array of horizontally aligned channels extending through a front surface of the housing; each of said channels having opposed side walls, a ceiling and a floor; each of said side walls being vertically aligned parallel to one another and perpendicular to the ceiling and floor of the channels; the floors of each array of channels being coplanar and the ceilings of each array of channels being coplanar; and at least one frangible dielectric projection extending from each ceiling a part of the distance into each channel toward a channel floor; and (b) a plurality of electrical contacts, one contact mounted in each channel; each of said electrical contacts comprising a blade portion having a raised bump on the top of each blade and having a lead extending out of its channel; each blade being adapted to fit in a space between the side walls, floor and projection of said channels; each bump adapted to engage and at least partially sever the frangible dielectric projection when the electrical contacts are inserted into the channels thereby biasing an insertion force of said contacts toward each of the channel floors.

The invention still further provides a method for forming an electrical connection comprising:

(a) providing a housing comprising an insulating material having at least one array of horizontally aligned channels extending through a front surface of the housing; each of said channels having opposed side walls, a ceiling and a floor; each of said side walls being vertically aligned parallel to one another and perpendicular to the ceiling and floor of the channels; the floors of each array of channels being coplanar and the ceilings of each array of channels being coplanar; and at least one frangible dielectric projection extending from each ceiling a part of the distance into each channel toward a channel floor; and (b) providing a plurality of electrical contacts, one contact being mountable in each channel; each of said electrical contacts comprising a blade portion having a raised bump on the top of each blade and having a lead extending out of its channel; each blade being adapted to fit in a space between the side walls, floor and projection of said channels; each bump adapted to engage and at least partially sever the frangible dielectric projection when the electrical contacts are inserted into the channels thereby biasing an insertion force of said contacts toward each of the channel floors; and (c) pressing the electrical contacts into the channels, thus at least partially severing the frangible dielectric projections in the channels and biasing an insertion force on the electrical contacts toward each of the channel floors.

The invention still further provides an electrical connector comprising a housing comprising an insulating material having at least one channel extending through a surface of the housing; said channel being defined by internal peripheral walls; and at least one frangible dielectric projection extending from an internal wall of the channel at least a part of the distance into the channel.

DETAILED DESCRIPTION OF THE PREFERRED EMBODIMENT

Figure 1:
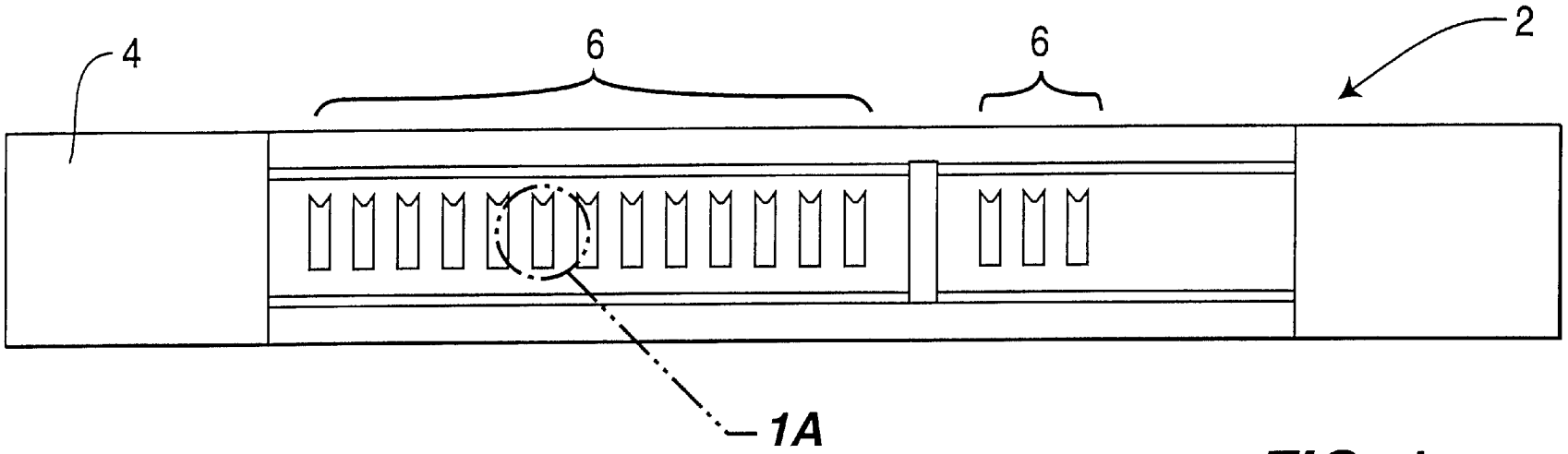
FIG. 1 shows a shows a front view of an electrical connector according to the invention.

Referring to the drawings, FIG. 1 shows an electrical connector 2 according to the invention. The connector has an insulating housing 4 composed of a suitable thermoplastic dielectric material such as polyamide, polycarbonate, polyester, glass filled polyester or a polyetherimide such as Ultem™ available from GE Plastics. The housing 4 has at least one array 6 of linearly aligned channels 8 extending through a surface of the housing. Each of the channels 8 are defined by internal peripheral walls including side walls 10, a floor 12 and a ceiling 14. At least one frangible dielectric projection 16 extends from one of the internal peripheral walls, preferably ceiling 14, and extends a part of the distance into the open channel 8. As may be seen in FIG. 1, projections 16 are preferably situated at a same position on each channel wall, i.e. at the ceiling in this case. Alternatively, some of the projections can be positioned at a opposite position on each channel, i.e. at the floor 12.

Figure 2:
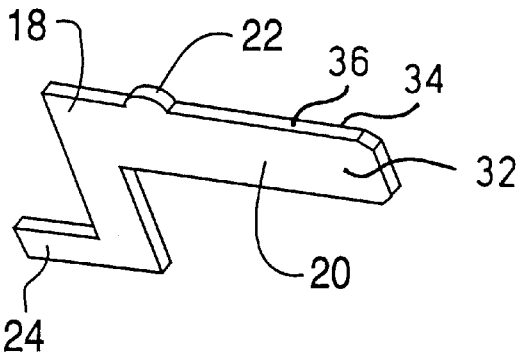
FIG. 2 shows a perspective view of a metal contact having a raised bump.
Figure 1A:
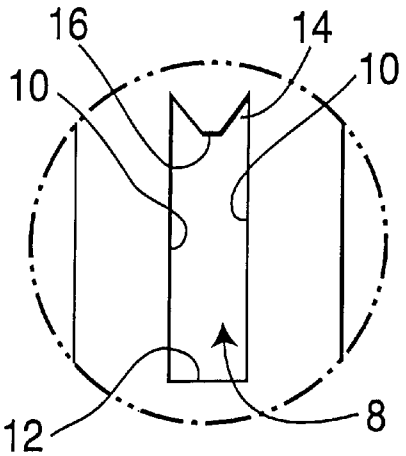
FIG. 1*a* shows an enlarged view of a portion of the electrical connector shown in FIG. 1.
Figure 3:
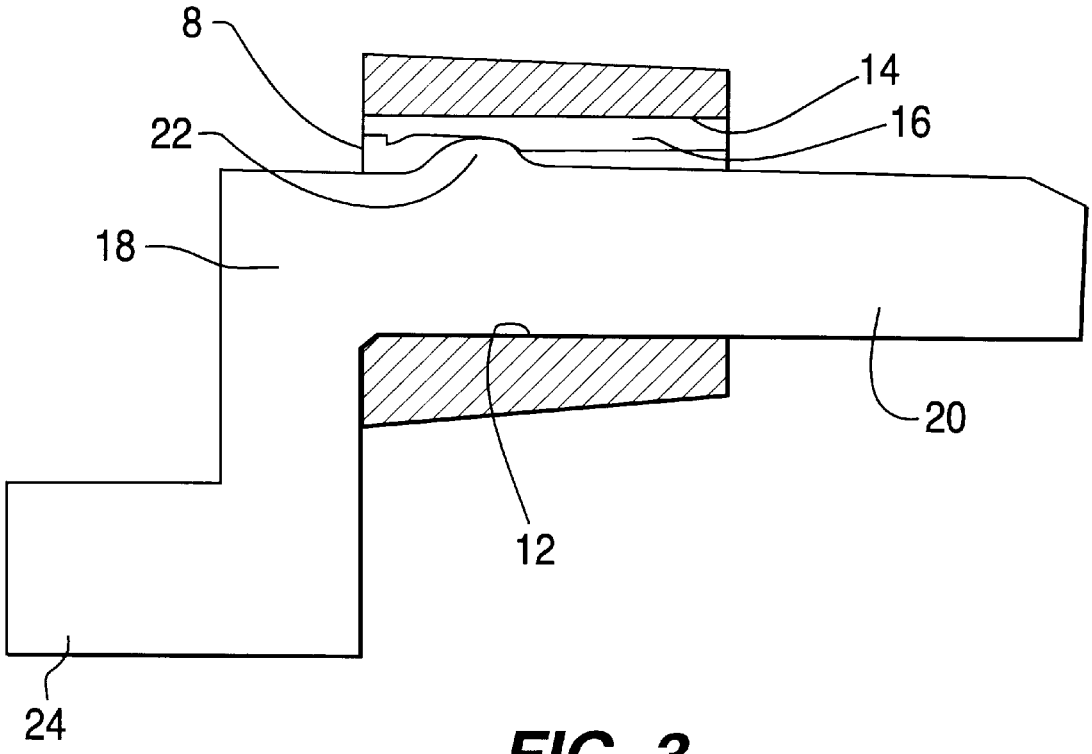
FIG. 3 shows a side cross sectional view of the metal contact positioned in a channel of the connector.

The electrical connector further comprises a plurality of metal contacts 18 wherein one such contact is mounted in each channel 8. As seen in FIG. 2, the preferred contact 18 comprises a planar blade portion 20 having opposite major surfaces 32, 34 and a peripheral edge 36. A raised bump 22 is formed along the peripheral edge. The contact further has a lead 24 at its tail end. As shown in FIG. 3, each blade 18 is adapted to fit in a channel 20 between the internal peripheral walls, including side walls 10, floor 12 and ceiling 14. In use, the blade 20 is pressed into a channel 8 between side walls 10, floor 12 and ceiling 14 and frangible dielectric projection 16. When the contact is pressed into the channel, bump 22 engages and at least partially severs the frangible dielectric projection 16 thereby directing the insertion force of the contacts in a direction normal to the projections, i.e. toward the floor. In the usual case, the amount of the dielectric material between channels 8 is extremely small compared to the amount above and below the channel. This downward biasing of insertion forces reduces side to side insertion forces and effectively prevents side to side cracking of the housing. Cracking above and below the channel is much less likely due the greater housing mass at these locations. Insertion forces are reduced because the entire top of the blade 20 does not engage the ceiling 14 or projection 16. Rather, only bump 22 engages projection 16. When a contact 18 is pressed into channel 8, the bump 22 deforms, ruptures or ablates, and displaces the projection 16 within the channel and holds the contact is place in the channel 8. In the usual case, the projection 16 is V-shaped so as to allow displacement space for the ruptured projection in the channel. However, the projection could also be rounded, beveled, or placed offset for center accumulation. Preferably the projections are integrally molded with the ceiling of each channel.

FIG. 3 shows a contact 18 mounted within a channel 8. As shown, there is only a single projection extending through the entire depth of the channel 8. However, the projection could just as well extend only a part of the distance through the channel or the projection could be discontinuous, i.e. there could be more than one projection in the channel.

In the construction of a multi-contact connector, the array of contact tail leads 24 must be in coplanar alignment to a close tolerance for effective soldering to cooperating circuitry. Such coplanarity is effectively achieved by the invention when the lowest part of each blade 20 is accurately positioned against floor 12 by projections 16. Such coplanarity of the array of fragile contacts 18 allows effective electrical connection with a mating forked contact 26 present on a cooperating connector (not shown). Contact 18 is a robust contact made from thick material easily capable of rupturing projections 16. This is why a means of containing the contacts in the channels is necessary.

Figure 4:
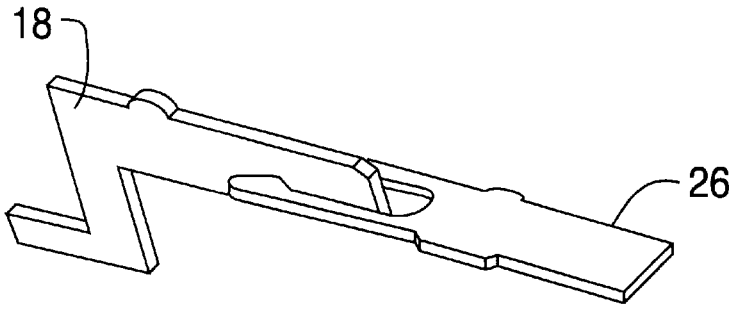
FIG. 4 shows a perspective view of a metal contact engaging a mating forked contact.
Figure 5:
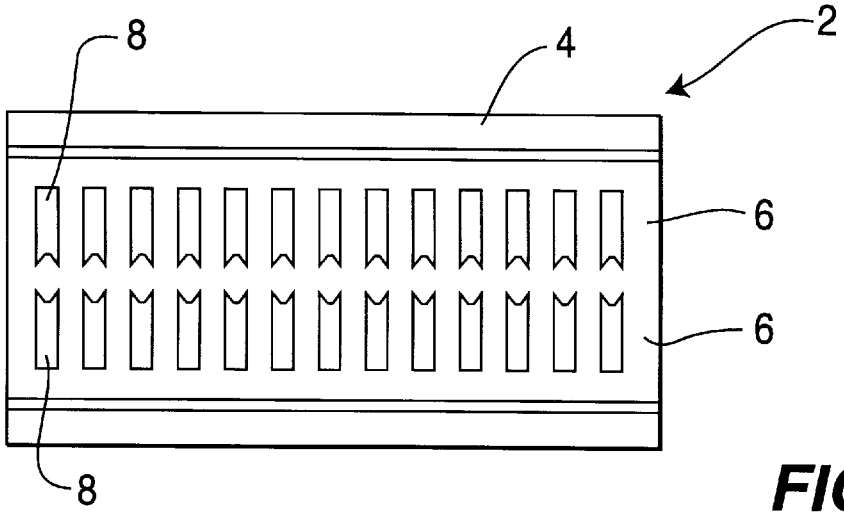
FIG. 5 shows a front view of an alternate embodiment of an electrical connector according to the invention.

As shown in FIG. 1, there can be several arrays 6 of channels at the front surface of the housing. FIG. 1 shows two horizontally spaced arrays of channels. FIG. 5 shows an alternate embodiment of the invention where two vertically spaced arrays of channels. The invention contemplates any number of channels in an array and any number of arrays orthogonally spaced from one another. Also as seen in FIG. 4, the upper array has the projections extending from the floor of the channels 8 while the lower array has the projections extending from the ceiling of the channels 8. The contact insertion forces would be directed toward the top of the connector by the upper array and the contact insertion forces would be directed toward the bottom of the connector by the lower array.

Figure 6:
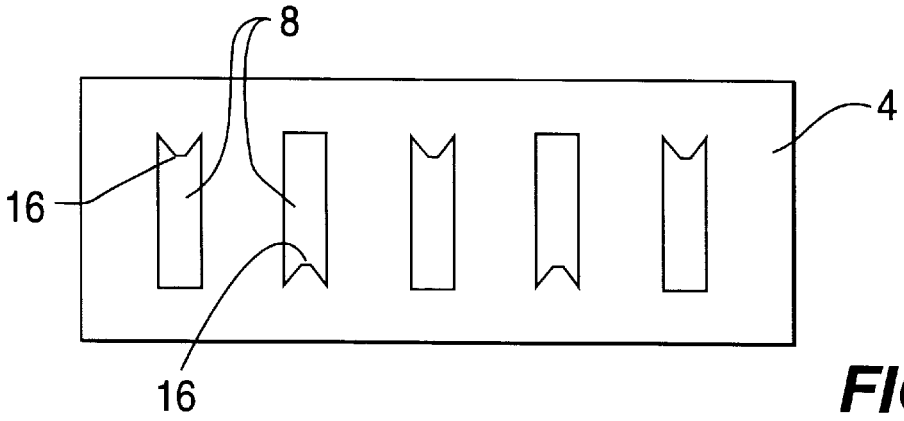
FIG. 6 shows another embodiment of the invention where some of the projections are positioned at the ceiling of a channel and some are positioned at the floor of a channel.
Figure 7:
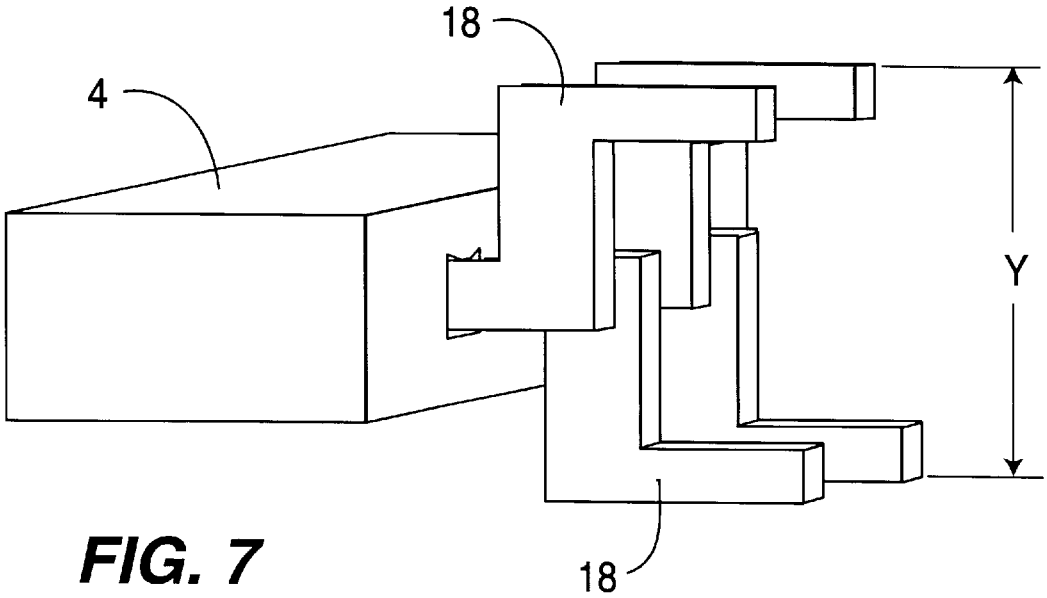
FIG. 7 shows contacts arranged in channels an alternating up and down configuration.

While the drawings exemplify an upwardly or downwardly directed insertion force, it is to be understood that the forces can be directed in any desired direction when a frangible projection in a channel cooperates with an outwardly extending bump on a contact. Furthermore, while the channels have been shown to be rectangular, they can just as well take another shape such as circular, T-shaped, or polygonal. FIG. 6 shows another embodiment of the invention where some of the projections 16 are positioned at the ceiling of channel 8 and some of the projections 16 are positioned at the floor of channel 8. The projections at the floor and ceiling direct insertion forces up and down rather than side to side. An optional alternating arrangement of projections in adjacent cavities allows contacts 18 to be arranged in an alternating up and down configuration as shown in FIG. 7 which allows excellent positioning control between planar surfaces separated by a distance Y.

An advantage of the present invention is the provision of an electrical connector which is much less likely to fracture when contacts are inserted into a dielectric housing. In addition, an array of contacts mounted in the connector can be critically aligned with one another for more accurate mating with corresponding connectors or assembly to planar surfaces.

What is claimed is:

1. An electrical connector comprising:

a housing comprising an insulating material having an array of linearly aligned channels extending through a surface of the housing, each of said channels being defined by internal peripheral walls including opposed side walls, a ceiling and a floor, a frangible dielectric projection extending into each said channel from one of the ceiling and the floor; and a contact having a blade portion mounted in each said channel, each said blade portion having opposite major surfaces connected by a peripheral edge, the opposite major surfaces being disposed parallel to respective ones of the opposed side walls, and the peripheral edge having a raised bump adapted to engage and at least partially sever the frangible dielectric projection when the blade portion is inserted into the channel, thereby biasing each said contact in a direction away from a corresponding said projection.

2. The electrical connector of claim 1 wherein the frangible dielectric projections are situated at a same relative position in each channel.

3. The electrical connector of claim 1 wherein the frangible dielectric projections are V-shaped.

4. The electrical connector of claim 1 wherein each of the channels extends for a depth from the surface into the housing, and the frangible dielectric projections extend from the surface of the housing fully along the depth of each said channel.

5. The electrical connector of claim 1 wherein each of the channels extends for a depth from the surface into the housing, and the frangible dielectric projections extend along a portion of the depth of each said channel.

6. The electrical connector of claim 1 further comprising another array of linearly aligned said channels extending through the surface of the housing, the arrays being spaced-apart.

7. An electrical connector comprising:

a housing comprising an insulating material having an array of horizontally aligned channels extending through a front surface of the housing, each of said channels having opposed side walls, a ceiling and a floor, said side walls being vertically aligned parallel to one another and perpendicular to the ceiling and the floor of the channel, the floors of the array of channels being coplanar and the ceilings of the array of channels being coplanar, and a frangible dielectric projection extending from each said ceiling into each said channel; and a plurality of electrical contacts associated with the channels, each of the electrical contacts comprising a blade portion having opposite major surfaces connected by a peripheral edge, and a raised bump on the peripheral edge, the blade portion being adapted to fit in a respective said channel with the opposite major surfaces of the blade portion disposed parallel to the opposed side walls of the channel, the bump adapted to engage and at least partially sever the frangible dielectric projection in the respective said channel when the electrical contacts are inserted into the channels, thereby biasing said contacts toward the floors of the channels.

8. The electrical connector of claim 7 wherein the frangible dielectric projections are V-shaped.

9. The electrical connector of claim 7 wherein each of the channels extends for a depth from the front surface into the housing, and the frangible dielectric projections extend from the front surface fully along the depth of each said channel.

10. The electrical connector of claim 7 wherein each of the channels extends for a depth from the front surface into the housing, and the frangible dielectric projections extend along a portion of the depth of each said channel.

11. The electrical connector of claim 7 wherein the frangible dielectric projections are integrally molded with the ceilings of the channels.

12. The electrical connector of claim 7 further comprising another array of horizontally aligned said channels extending through the front surface of the housing, the arrays being spaced-apart.

13. The electrical connector of claim 7 further comprising another array of horizontally aligned said channels extending through the front surface of the housing, the arrays being horizontally spaced-apart.

14. The electrical connector of claim 7 further comprising another array of horizontally aligned said channels extending through the front surface of the housing, the arrays being vertically spaced-apart.

15. A method for forming an electrical connection comprising:

(a) providing a housing comprising an insulating material having an array of horizontally aligned channels extending through a front surface of the housing, each of said channels having opposed side walls, a ceiling and a floor, the side walls being vertically aligned parallel to one another and perpendicular to the ceiling and the floor of the channel, the floors of the array of channels being coplanar and the ceilings of the array of channels being coplanar, and a frangible dielectric projection extending from each said ceiling into each said channel; and (b) providing a plurality of electrical contacts associated with the channels, each of the electrical contacts comprising a blade portion having opposite major surfaces connected by a peripheral edge, and a raised bump on the peripheral edge the blade portion being adapted to fit in a respective said channel with the opposite major surfaces of the blade portion disposed parallel to the opposed side walls of the channel, the bump adapted to engage and at least partially sever the frangible dielectric projection in the respective said channel when the electrical contacts are inserted into the channels; and (c) inserting the electrical contacts into the channels, thus at least partially severing the frangible dielectric projections in the channels and biasing the electrical contacts toward the floors of the channels.

16. The method of claim 15 wherein the frangible dielectric projections are V-shaped.

17. The method of claim 15 wherein each of the channels extends for a depth from the front surface into the housing, and the frangible dielectric projections extend from the front surface fully along the depth of each said channel.

18. The method of claim 15 wherein each of the channels extends for a depth from the front surface into the housing, and the frangible dielectric projections extend from along a portion of the depth of each said channel.

19. The method of claim 15 wherein the frangible dielectric projections are integrally molded with the ceilings of the channels.

20. The method of claim 15 further comprising another array of horizontally aligned said channels extending through the front surface of the housing, the arrays being spaced-apart.

21. The method of claim 15 further comprising another array of horizontally aligned said channels extending through the front surface of the housing, the arrays being horizontally spaced-apart.

22. The method of claim 15 further comprising another array of horizontally aligned said channels extending through the front surface of the housing, the arrays being vertically spaced-apart.

* * * * *